US006439697B1

(12) United States Patent
Axtell et al.

(10) Patent No.: US 6,439,697 B1
(45) Date of Patent: Aug. 27, 2002

(54) DYNAMIC MEMORY BASED FIRING CELL OF THERMAL INK JET PRINTHEAD

(75) Inventors: James P. Axtell; Trudy L. Benjamin, both of Portland, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/365,110

(22) Filed: Jul. 30, 1999

(51) Int. Cl.[7] ..... B41J 2/05
(52) U.S. Cl. ..... 347/57; 347/58
(58) Field of Search ..... 347/57, 58, 59, 347/9, 12, 13

(56) References Cited

U.S. PATENT DOCUMENTS

| | | | | |
|---|---|---|---|---|
| 4,719,477 A | | 1/1988 | Hess | 347/59 |
| 5,278,584 A | | 1/1994 | Keefe et al. | 347/63 |
| 5,317,346 A | | 5/1994 | Garcia | 347/63 |
| 5,469,199 A | | 11/1995 | Allen et al. | 347/42 |
| 5,508,724 A | | 4/1996 | Boyd et al. | 347/58 |
| 5,598,189 A | | 1/1997 | Hess et al. | 347/9 |
| 5,600,349 A | | 2/1997 | Keefe | 347/11 |
| 5,608,431 A | | 3/1997 | Kishida et al. | 347/13 |
| 5,635,968 A | | 6/1997 | Bhaskar et al. | 347/59 |
| 5,638,101 A | * | 6/1997 | Keefe et al. | 347/58 |
| 5,644,342 A | | 7/1997 | Argyres | 347/12 |

FOREIGN PATENT DOCUMENTS

| | | | |
|---|---|---|---|
| EP | 0592221 | 4/1994 | B41J/2/05 |
| EP | 0913255 | 5/1999 | B41J/2/05 |
| WO | WO9851509 | 11/1998 | B41J/29/38 |

OTHER PUBLICATIONS

European Search Report, Jul. 4, 2001, Application No. 00306398.

* cited by examiner

*Primary Examiner*—John Barlow
*Assistant Examiner*—Juanita Stephens
(74) *Attorney, Agent, or Firm*—Manuel Quiogue

(57) ABSTRACT

A dynamic memory based integrated circuit ink jet firing cell that includes a heater resistor, a drive transistor, and a dynamic memory circuit for storing firing data only for such heater resistor. Also disclosed is an integrated circuit firing array that includes a plurality of dynamic memory based firing cells divided into a plurality of fire groups of firing cells, each fire group having a plurality of subgroups; data lines for providing energizing data to the firing cells; control lines for providing control information to the firing cells wherein all firing cells within a subgroup are connected to a common subset of the control lines so as to be controlled to concurrently store energizing data; and a plurality fire lines for supplying energizing energy to the firing cells, wherein all firing cells of a fire group receive energizing energy from only one fire line.

15 Claims, 12 Drawing Sheets

DYNAMIC MEMORY BASED FIRING CELL OF THERMAL INK JET PRINTHEAD

BACKGROUND OF THE INVENTION

The subject invention generally relates to ink jet printing, and more particularly to thin film ink jet printheads having integrated dynamic memory circuitry within each firing cell.

The art of ink jet printing is relatively well developed. Commercial products such as computer printers, graphics plotters, and facsimile machines have been implemented with ink jet technology for producing printed media. The contributions of Hewlett-Packard Company to ink jet technology are described, for example, in various articles in the *Hewlett-Packard Journal*, Vol. 36, No. 5 (May 1985); Vol. 39, No. 5 (October 1988); Vol. 43, No. 4 (August 1992); Vol. 43, No. 6 (December 1992); and Vol. 45, No. 1 (February 1994); all incorporated herein by reference.

Generally, an ink jet image is formed pursuant to precise placement on a print medium of ink drops emitted by an ink drop generating device known as an ink jet printhead. Typically, an ink jet printhead is supported on a movable carriage that traverses over the surface of the print medium and is controlled to eject drops of ink at appropriate times pursuant to command of a microcomputer or other controller, wherein the timing of the application of the ink drops is intended to correspond to a pattern of pixels of the image being printed. An ink jet printhead is commonly mounted on an ink jet print cartridge that, for example, can include an integral ink reservoir.

A typical Hewlett-Packard ink jet printhead includes an array of precisely formed nozzles in an orifice or nozzle plate that is attached to an ink barrier layer which in turn is attached to a thin film substructure that implements ink firing heater resistors and apparatus for enabling the resistors. The ink barrier layer defines ink channels including ink chambers disposed over associated ink firing resistors, and the nozzles in the orifice plate are aligned with associated ink chambers. Ink drop generator regions are formed by the ink chambers and portions of the thin film substructure and orifice plate that are adjacent the ink chambers.

The thin film substructure is typically comprised of a substrate such as silicon on which are formed various thin film layers that form thin film ink firing heater resistors, circuitry for enabling the transfer of ink firing energy to the heater resistors, and also conductive traces to interface pads that are provided for external electrical interconnections to the printhead.

The ink barrier layer is typically a polymer material that is laminated as a dry film to the thin film substructure, and is designed to be photo-definable and both UV and thermally curable.

An example of the physical arrangement of the orifice plate, ink barrier layer, and thin film substructure is illustrated at page 44 of the *Hewlett-Packard Journal* of February 1994, cited above. Further examples of ink jet printheads are set forth in commonly assigned U.S. Pat. No. 4,719,477 and U.S. Pat. No. 5,317,346, both of which are incorporated herein by reference.

There is a trend in thermal ink jet technology to increase the number of nozzles constructed on a single printhead as well as to increase the firing rate of those nozzles. As the number of nozzles increase, the number of external electrical interconnections to the printhead increases dramatically unless some form of multiplexing is implemented wherein some of the interconnections are shared by the ink firing resistors on a time division basis so as to reduce the number of interconnections to the printhead.

A known multiplexing scheme involves the provision of a gating transistor for each ink firing resistor, whereby current to an ink firing resistor flows only when its associated gating transistor is selected (i.e., rendered conductive). By arranging each resistor and associated transistor in a matrix of rows and columns, the total number of external electrical interconnections is substantially reduced. Printheads employing this multiplexing scheme have been made using low cost NMOS integrated circuit processing.

Optimally, the matrix of rows and columns would be square (i.e., the number of rows equals the number of columns) in order to have a minimum number of external interconnections. However, the matrix is typically implemented as a rectangular matrix as result of system requirements such as the maximum rate at which each resistor can be successively energized (firing rate), the time between successive firings of different resistors (firing cycle), and the number of resistors that can be fired in a firing cycle. With a rectangular matrix, the number of external interconnections is considerably greater than the square optimum.

Another known interconnect reduction scheme incorporates logic circuitry and static memory elements on the printhead substrate within each firing cell and on the periphery of the array of firing cells. In this scheme, while one row or column of heater resistors is firing, static memory elements receive and store firing data for the next row or column of resistors to be energized. An example of a printhead that incorporates logic circuitry and static memory elements on the printhead substrate for multiplexing is the Hewlett-Packard C4820A 524-nozzle printhead used by the Hewlett-Packard DesignJet 1050C large format printer. A consideration with incorporating logic circuitry and static memory elements on a printhead substrate is that this typically requires a more complex integrated circuit process, such as CMOS, which increases cost as compared to NMOS integrated circuit processing since CMOS processing typically requires more mask levels and processing steps than NMOS processing. Moreover, incorporating logic circuitry on the periphery of the firing array increases the complexity of the layout process, which increases overall development time for new or modified printheads.

For typical non-printhead integrated circuits, the cost of an individual die CA can be reduced over time by implementing the same functions in a more complex (and thereby more expensive) integrated circuit process that produces smaller die sizes with the same functionality. A smaller die results in more die per fixed size wafer and thus an overall lower cost per die, even though wafer cost increases as a result of the increased process complexity.

Ink jet printheads made with integrated circuit processes cannot follow the typical integrated circuit cost trend of smaller die and therefore lower cost, since the size of an integrated circuit ink jet printhead is fixed in one dimension by the desired print swath height, and in a second dimension by the desired number of independent fluidic channels and their physical spacing requirements. The increased cost of printheads fabricated with integrated circuit processes of greater complexity cannot be offset by reductions in the size of the printhead without losing printhead functionality such as a loss in printing throughput or a loss in the number of colors on each printhead.

There is therefore a need for an integrated circuit ink jet printhead having reduced external interconnections and which can be made using low cost NMOS integrated circuit processing.

SUMMARY OF THE INVENTION

The disclosed invention is directed to a dynamic in memory based integrated circuit ink jet firing cell that includes an ink jet heater resistor, a dynamic memory circuit for storing heater resistor energizing data only for the heater resistor, and a drive transistor for enabling a transfer of energy to the heater resistor as a function of the state of the energizing data.

A further aspect of the invention is directed to an integrated circuit firing array that includes a plurality of dynamic memory based firing cells divided into a plurality of fire groups of firing cells, each fire group having a plurality of subgroups; data lines for providing energizing data to the firing cells; control lines for providing control information to the firing cells wherein all firing cells within a subgroup are connected to a common subset of the control lines so as to be controlled to concurrently store energizing data; and a plurality fire lines for supplying energizing energy to the firing cells, wherein all firing cells of a fire group receive energizing energy from only one fire line.

BRIEF DESCRIPTION OF THE DRAWINGS

The advantages and features of the disclosed invention will readily be appreciated by persons skilled in the art from the following detailed description when read in conjunction with the drawing wherein.

DETAILED DESCRIPTION OF THE DISCLOSURE

Figure 1:
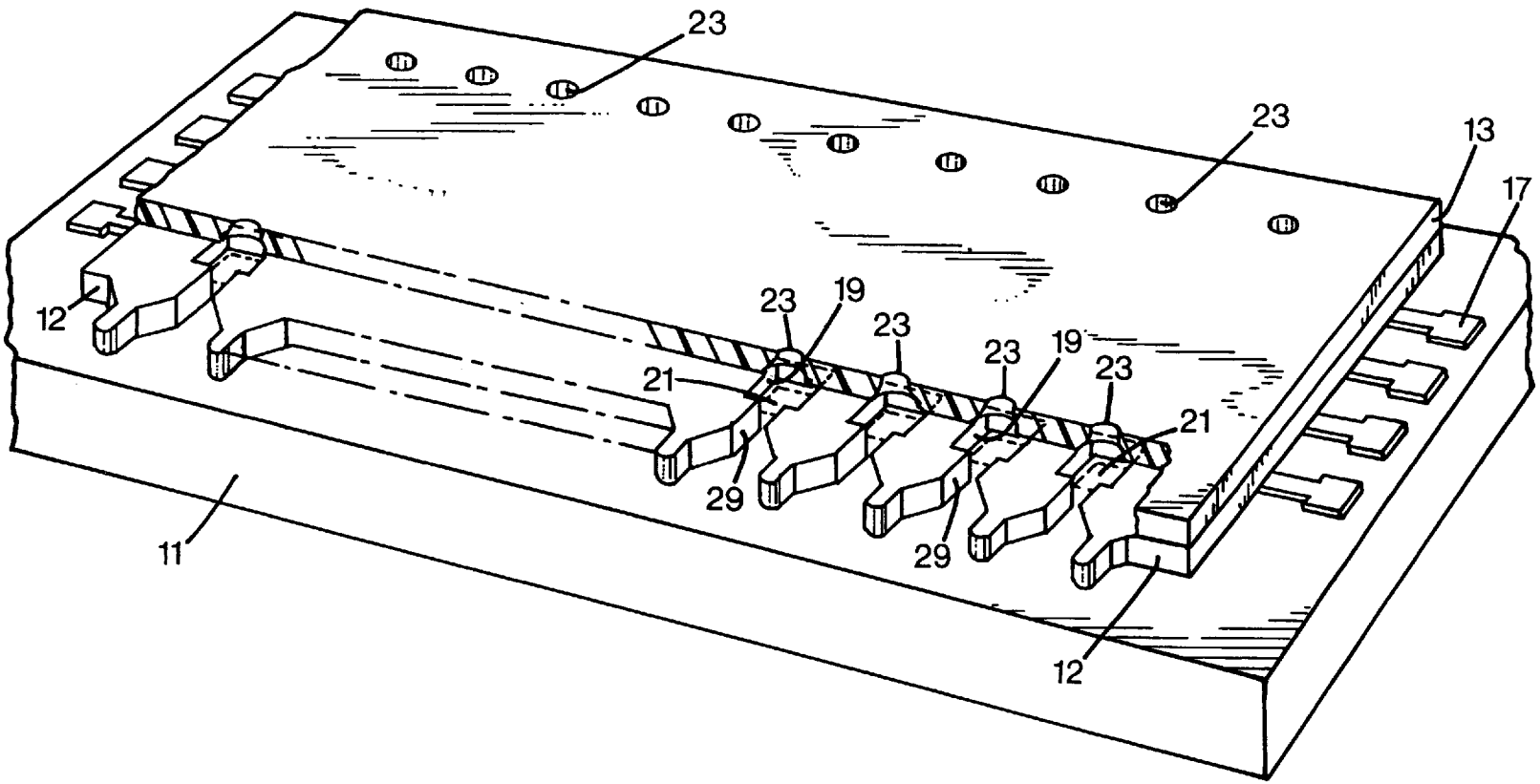
FIG. 1 sets forth a schematic, partially sectioned perspective view of major components of an ink jet printhead in which the invention is employed.

In the following detailed description and in the several figures of the drawing, like elements are identified with like reference numerals.

Referring now to FIG. 1, set forth therein is an unscaled schematic perspective view of an ink jet printhead in which the invention can be employed and which generally includes (a) a thin film substructure or die 11 comprising a substrate such as silicon and having various thin film layers formed thereon, (b) an ink barrier layer 12 disposed on the thin film substructure 11, and (c) an orifice or nozzle plate 13 attached to the top of the ink barrier layer 12.

In accordance with the invention, the thin film substructure 11 is an NMOS integrated circuit that includes ink firing cell circuits each of which includes a dynamic memory element respectively and exclusively associated with a heater resistor 21 which is also formed in the thin film substructure 11. The thin film substructure 11 is formed pursuant to known integrated circuit techniques, for example as disclosed in commonly assigned U.S. Pat. No. 5,635,968 and U.S. Pat. No. 5,317,346, both incorporated herein by reference.

The ink barrier layer 12 is formed of a dry film that is heat and pressure laminated to the thin film substructure 11 and photodefined to form therein ink chambers 19 and ink channels 29 which are disposed over resistor regions which are on either side of a generally centrally located gold layer 15 (FIG. 2) on the thin film substructure 11. Gold bonding or contact pads 17 engagable for external electrical interconnections are disposed at the ends of the thin film substructure and are not covered by the ink barrier layer 12. As discussed further herein with respect to FIG. 2, the thin film substructure 11 includes a patterned gold layer 15 generally disposed in the middle of the thin film substructure 11 between the rows of heater resistors 21, and the ink barrier layer 12 in covers most of such patterned gold layer 15, as well as the areas between adjacent heater resistors 21. By way of illustrative example, the barrier layer material comprises an acrylate based photopolymer dry film such as the Parad brand photopolymer dry film obtainable from E.I. duPont de Nemours and Company of Wilmington, Del. Similar dry films include other duPont products such as the Riston brand dry film and dry films made by other chemical providers. The orifice plate 13 comprises, for example, a planar substrate comprised of a polymer material and in which the orifices are formed by laser ablation, for example as disclosed in commonly assigned U.S. Pat. No. 5,469,199, incorporated herein by reference. The orifice plate 13 can also comprise a plated metal such as nickel.

The ink chambers 19 in the ink barrier layer 12 are more particularly disposed over respective ink firing resistors 21, and each ink chamber 19 is defined by the edge or wall of a chamber opening formed in the barrier layer 12. The ink channels 29 are defined by further openings formed in the barrier layer 12, and are integrally joined to respective ink firing chambers 19. By way of illustrative example, FIG. 1 illustrates an outer edge fed configuration wherein the ink channels 29 open towards an outer edge formed by the outer perimeter of the thin film substructure 11 and ink is supplied to the ink channels 29 and the ink chambers 19 around the outer edges of the thin film substructure, for example as more particularly disclosed in commonly assigned U.S. Pat. No. 5,278,584, incorporated herein by reference. The invention can also be employed in a center edge fed ink jet printhead such as that disclosed in previously identified U.S. Pat. No. 5,317,346, wherein the ink channels open towards an edge formed by a slot in the middle of the thin film substructure.

The orifice plate 13 includes orifices 23 disposed over respective ink chambers 19, such that an ink firing resistor 21, an associated ink chamber 19, and an associated orifice 23 are aligned. An ink firing cavity or ink drop generator region is formed by each ink chamber 19 and portions of the thin film substructure 11 and the orifice plate 13 that are adjacent the ink chamber 19.

Figure 2:
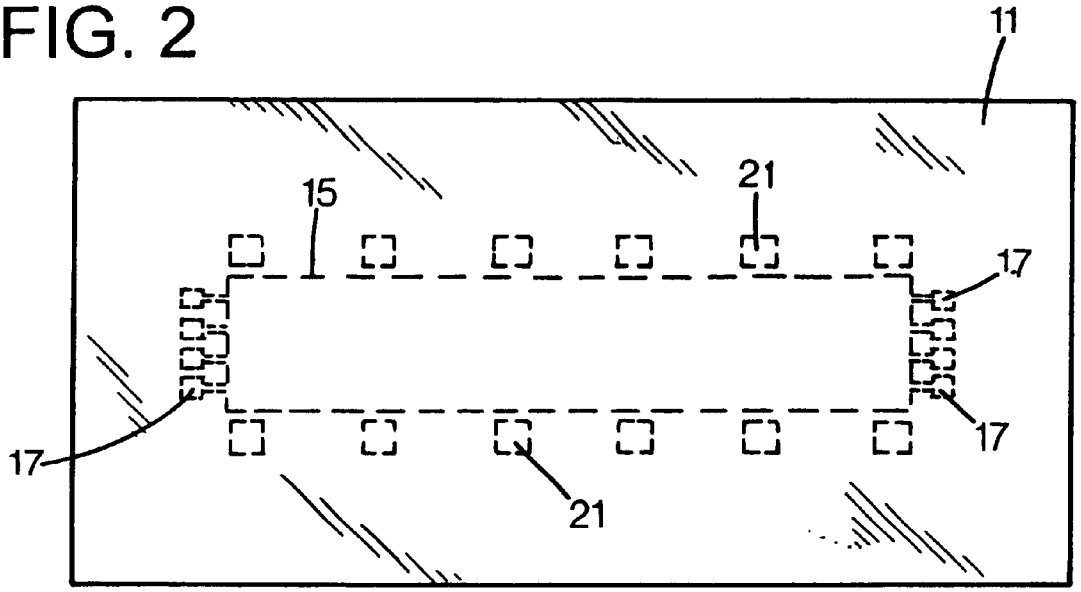
FIG. 2 is an unscaled schematic top plan illustration of the general layout of the thin film substructure of the ink jet printhead of FIG. 1.

Referring now to FIG. 2, set forth therein is an unscaled schematic top plan illustration of the general layout of the thin film substructure 11. The ink firing resistors 21 are formed in resistor regions that are adjacent the longitudinal edges of the thin film substructure 11. A patterned gold layer 15 comprised of gold traces forms the top layer of the thin film structure in a gold layer region located generally in the middle of the thin film substructure 11 between the resistor regions and extending between the ends of the thin film substructure 11. Bonding pads 17 for external electrical interconnections are formed in the patterned gold layer 15, for example adjacent the ends of the thin film substructure 11. The ink barrier layer 12 is defined so as to cover all of the patterned gold layer 15 except for the bonding pads 17, and also to cover the areas between the respective openings that form the ink chambers and associated ink channels. Depending upon implementation, one or more thin film layers can be disposed over the patterned gold layer 15.

While FIGS. 1 and 2 generally depict a roof-shooter type of ink jet printhead, it will be appreciated that the disclosed invention can be employed in any type of ink jet printhead that includes heater resistors, including side-shooter type ink jet printheads. It should also be appreciated that the disclosed invention can be employed in an ink jet printhead that prints a plurality of different colors.

Figure 3:
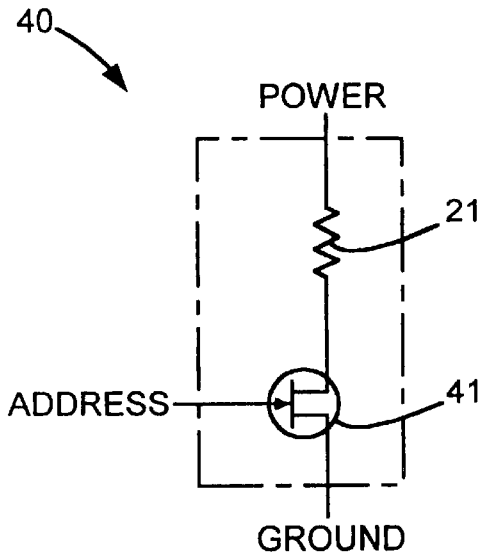
FIG. 3 PRIOR ART
FIG. 3 sets forth a schematic diagram of a known ink firing cell.

FIG. 3 sets forth a schematic representation of a prior art firing cell 40 that has been employed in thermal inkjet printheads. Transfer of energizing energy to the heater resistor 21 is selectively controlled by enabling or disabling a drive or gating transistor 41. For convenience, transfer of energizing energy to a heater resistor is sometimes referred to as firing or energizing the heater resistor.

Figure 3A:
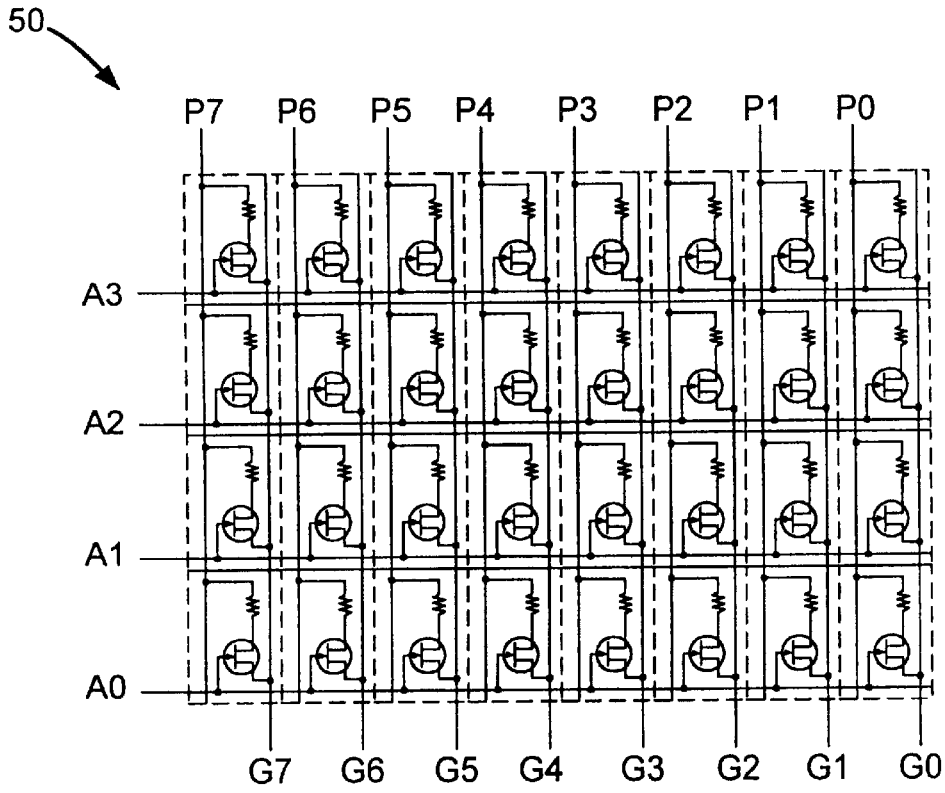
FIG. 3A PRIOR ART
FIG. 3A sets forth a schematic layout of an ink jet ink firing array employing a plurality of ink firing cells of FIG. 3.

FIG. 3A sets forth an array 50 of prior art firing cells 40. The firing cells are schematically interconnected such that all of the drive transistors in a single row of the array of firing cells are selected by a shared one of address lines A0–A3. All heater resistors in a single column of the array of firing cells are connected to a shared one of power lines P0–P7, and the sources of all drive transistors in a single column are connected to a shared one of ground lines G0–G7. Only one address line is enabled at any one time allowing only the heater resistors in the associated row of firing cells to be energized or fired at the same time. Each power line is switched or energized selectively depending upon whether or not the selected firing cell in the associated column is to be activated. Each row of firing cells is addressed and energized sequentially.

Optimally, the matrix or array of firing cells would be square in order to have a minimum number of external interconnections to the array. Mathematically, this minimum number of interconnections can be expressed as 2*SQRT(N) where N is the number of firing cells. However due to system requirements, the matrix is typically not square, but is instead rectangular and the resulting number of interconnections is larger than 2*SQRT(N). The determining factors include the maximum rate at which any resistor can be successively energized (firing rate) and the time it takes to prepare and energize (or fire) each row of heater resistors (firing cycle).

The time from the start of firing any given row of heater resistors to the start of firing of the next successive row of heater resistors is equal to the firing cycle. The reciprocal of the time required to fire all of the rows in an array is equal to the maximum firing rate. Equation 1 shows the relationship between the maximum firing rate, the firing cycle, and the number of rows. Note that the number of columns is independent of the maximum firing rate and the firing cycle.

$$\text{MAX_FIRE_RATE}=1/(\text{ROWS}*\text{FIRING_CYCLE}) \qquad \text{(Eq. 1)}$$

To increase the number of nozzles on a printhead without changing the basic system parameters of maximum firing rate and firing cycle, the number of rows must stay the same which means the number of columns must increase. If both the number of nozzles and the maximum firing rate increase, then the number of rows must decrease along with the increase in number of columns. This can result in very large increases in the total number of external interconnections needed for a given firing array.

Figure 4:
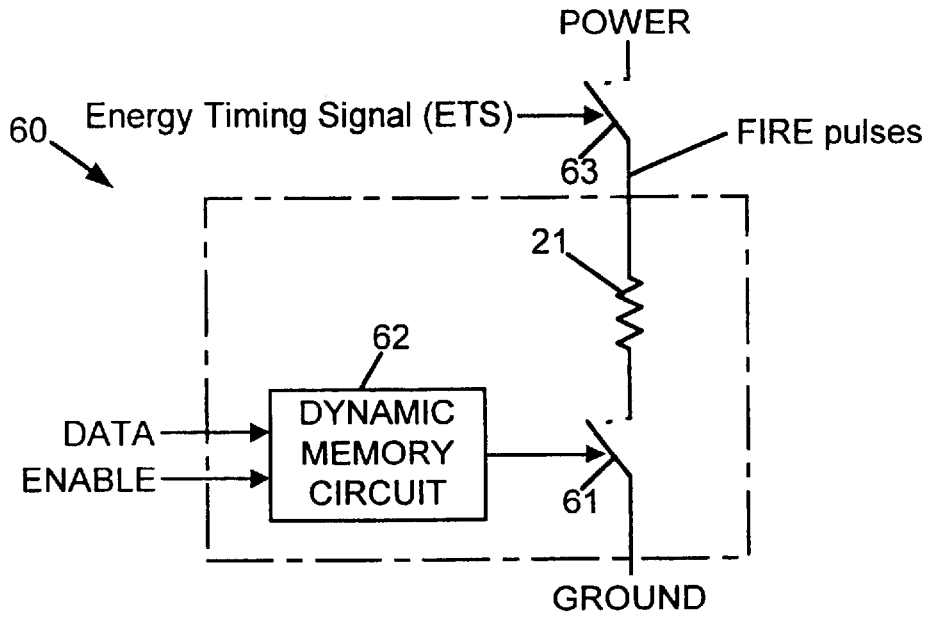
FIG. 4 sets forth a schematic block diagram of a dynamic memory based ink firing cell.

Referring now to FIG. 4, associated with each of the ink firing cavities of the printhead of FIGS. 1 and 2 is a dynamic memory based ink firing cell 60 that generally includes a heater resistor 21, a resistor drive switch 61 connected between one terminal of the heater resistor 21 and ground, and a dynamic memory circuit 62 that controls the state of the resistor drive switch 61, all of which are formed in the thin film substrate 11. Heater resistor energizing energy in the form of fire pulses (also called ink firing pulses) is made available to the heater resistor 21 by a power switch 63 that is controlled by an energy timing signal (ETS) and connected between a power source and the other terminal of the heater resistor 21. The dynamic memory circuit 62 is configured to store one bit of heater resistor energizing binary data that sets the resistor drive switch 61 to a desired state (e.g., on or off, or conductive or non-conductive) prior to the occurrence of a fire pulse. If the resistor drive switch 61 is on (i.e., conductive), the fire pulse energy will be transferred to the heater resistor 21. In other words, the resistor drive switch 61 is controlled by the dynamic memory circuit 62 to enable the transfer of a fire pulse to the heater resistor 21.

The dynamic memory circuit 62 more particularly receives DATA information and ENABLE information that enables the dynamic memory circuit to receive and store the DATA information. For convenience, such enabling of the dynamic memory circuit is sometimes referred to as selection or addressing of the memory circuit or the firing cell. As described further herein, the ENABLE information can include a SELECT control signal and/or one or more ADDRESS control signals.

Figure 5:
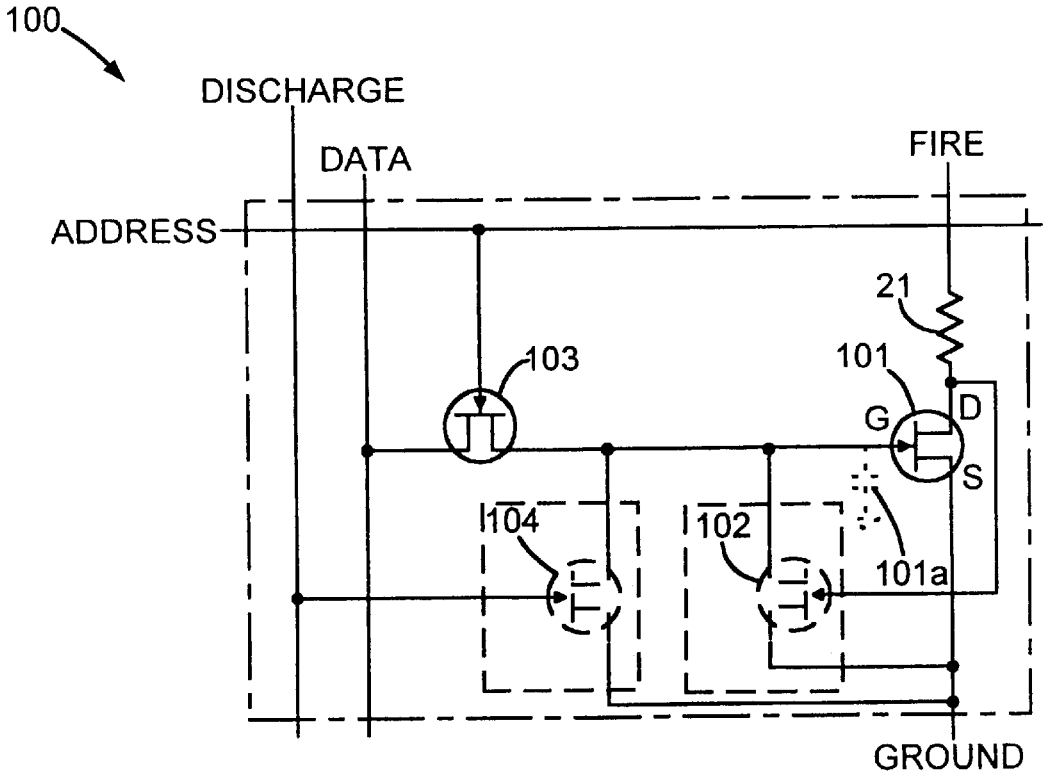
FIG. 5 sets forth a schematic circuit diagram of an example of a dynamic memory based ink firing cell.

Referring now to FIG. 5, set forth therein is a schematic diagram of an illustrative implementation of a dynamic memory based ink firing cell 100. The firing cell includes an N-channel drive PET (field effect transistor) 101 for driving a heater resistor 21. The drain of the drive transistor 101 is connected to one terminal of the heater resistor 21, while the source of the drive transistor 101 is connected to a common reference voltage such as ground. The other terminal of the heater resistor 21 receives a heater resistor energizing FIRE signal that comprises ink firing pulses. Firing pulse energy is transferred to the heater resistor 21 if the drive transistor 101 is on at the time a firing pulse is present.

The gate of the drive transistor 101 forms a storage node capacitance 101*a* that functions as a dynamic memory element that stores resistor energizing or firing data received via the output of a pass transistor 103 that is connected to the gate of the drive transistor 101. The storage node capacitance 101*a* is shown in dashed lines since it is actually part of the drive transistor 101. Alternatively, a capacitor separate from the drive transistor 101 can be used as a dynamic memory element. For increased flexibility as to discharging the capacitance 101*a* so as to set the capacitance to a known state, a discharge transistor 104 can be included. The discharge transistor 104 would have its drain connected to the gate of the drive transistor 101 and its source connected to ground, and a DISCHARGE select signal would be provided to the gate of the discharge transistor 104. The pass transistor 103 and the gate capacitance 101*a* effectively form a dynamic memory data storage cell.

The gate of the pass transistor 103 receives an ADDRESS signal that controls the state of the pass transistor 103, while the input of the pass transistor 103 receives a heater resistor energizing or firing DATA signal that is transferred to the gate of the drive transistor 101 when the pass transistor 103 is on.

Depending on the semiconductor processes utilized to implement the firing cell 100 of FIG. 5, a clamp transistor 102 connected across the drain and the gate of the drive transistor 101 may be required to prevent the gate of the drive transistor 101 from being unintentionally pulled high when the desired state of the gate is at ground and the FIRE signal goes high.

Figure 5A:
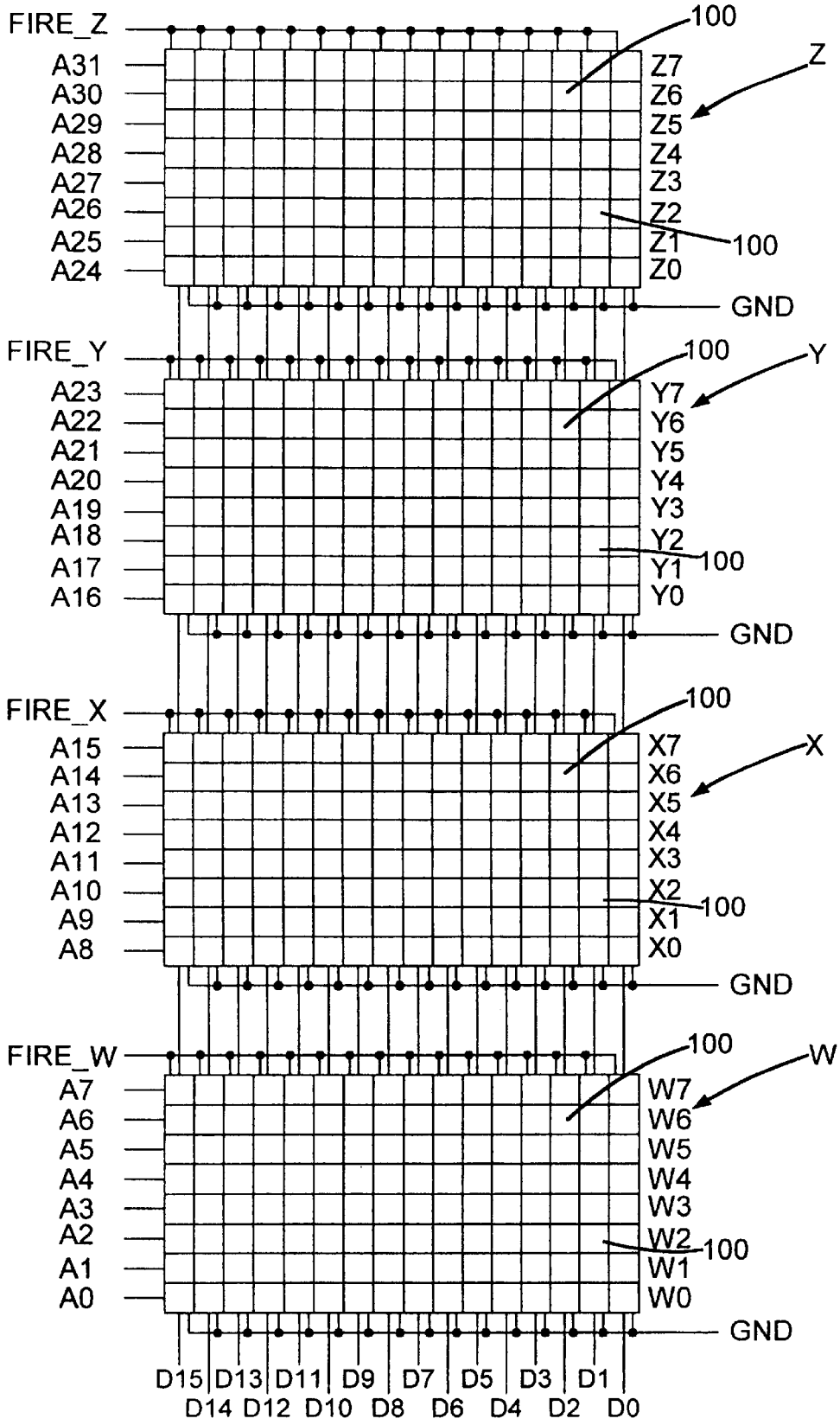
FIG. 5A sets forth a schematic layout of an ink jet ink firing array employing a plurality of ink firing cells of FIG. 5.

Referring now to FIG. 5A, set forth therein is a schematic layout of an ink jet ink firing array employing a plurality of dynamic memory based ink firing cells 100 of FIG. 5 that are arranged in four fire groups W, X, Y, Z, wherein the ink firing cells are schematically arranged in rows and columns in each of the fire groups, and wherein each firing cell 100 does not include the optional clamp transistor 102 or the optional discharge transistor 104. For reference, the rows of the respective ink firing groups W, X, Y and Z are respectively identified as rows W0 through W7, X0 through X7, Y0 through Y7 and Z0 through Z7. The number of fire groups can vary depending upon implementation, and the fire groups may or may not be closely associated with the different colors in a multi-color printhead.

Heater resistor energizing DATA signals are applied to data lines D0 through D15 that are associated with respective columns of all of the firing cells and are connected to external control circuitry by appropriate contact or interface pads. Each of the data lines is connected to all of the inputs of the pass transistors 103 of the ink firing cells 100 in an associated column, and each firing cell is connected to only one data line. Thus, each of the data lines provides energizing data to firing cells in multiple rows in multiple fire groups.

ADDRESS control signals are applied to address lines A0 through A31 that are associated with respective rows of all the firing cells and are connected to external control circuitry by appropriate interface pads. Each of the address lines is connected to all of the gates of the pass transistors 103 in the associated row, whereby all firing cells within a row are all connected to a common subset of the address lines, which in this case is one address line. Since all firing cells in a given row are all connected to the same address line, it is convenient to refer to a row of firing cells as an address row or a fire subgroup, whereby each fire group is comprised of a plurality of fire subgroups.

Heater resistor energizing FIRE signals are applied via fire lines FIRE_W, FIRE_X, FIRE_Y and FIRE_Z that are associated with the respective fire groups W, X, Y and Z, and are connected to external power supply circuitry by appropriate interface pads. Each of the fire lines is connected to all of the heater resistors in the associated fire group, and all cells in a fire group share a common ground.

Figure 5B:
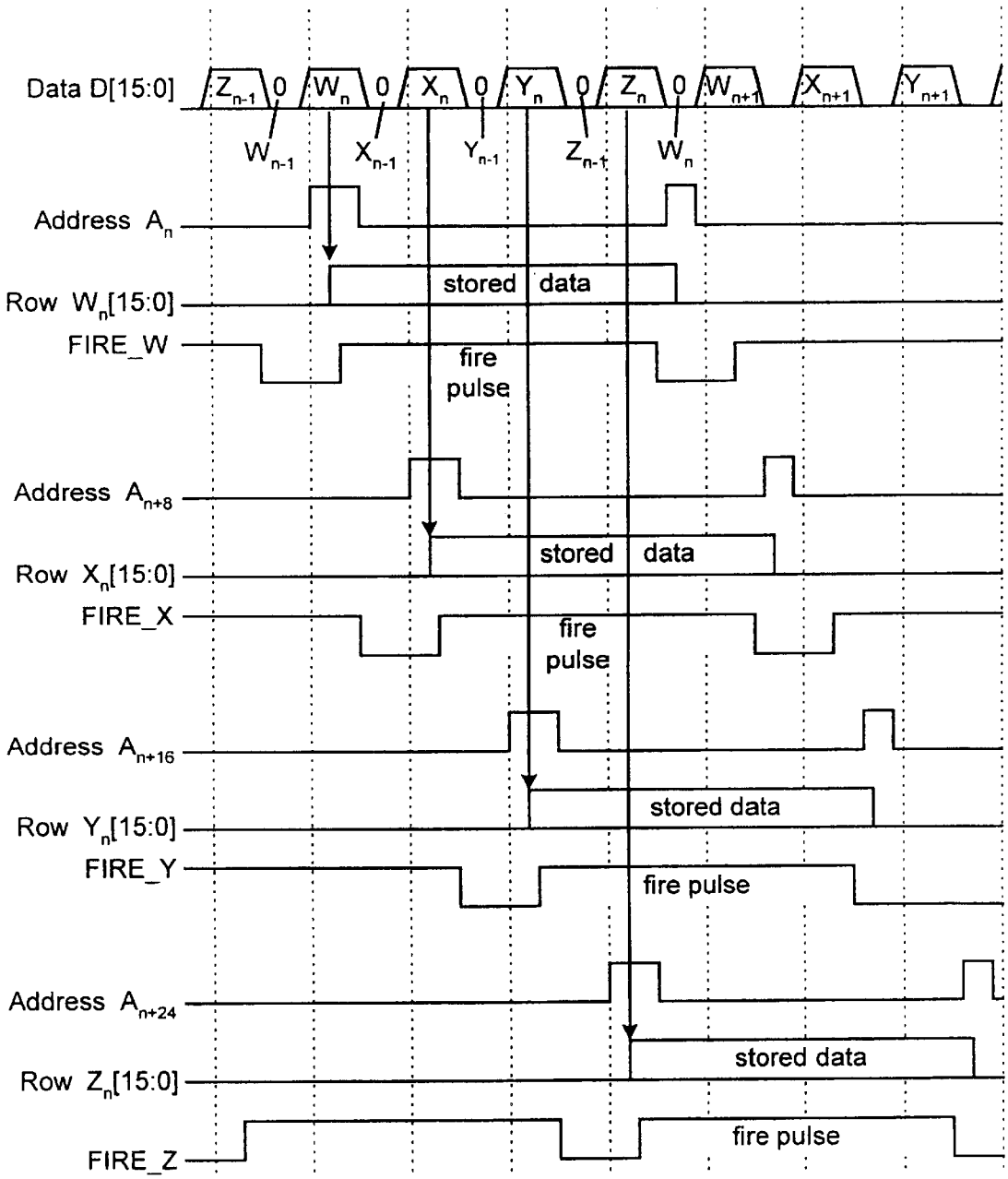
FIG. 5B sets forth a timing diagram for the ink jet ink firing array of FIG. 5A.

In operation, as illustrated in the timing diagram of FIG. 5B wherein timing traces are identified for convenience by row or by the particular control lines carrying the signals represented in the timing diagram, individual rows of firing cells are selected or addressed serially one row at a time, one row from each fire group in succession (i.e., by appropriate signals on address lines An, An+8, An+16, An+24, etc.), and with each address line selection DATA ($W_n$, $X_n$, $Y_n$, $Z_n$, and so forth) is applied in parallel to the data lines D[15:0]. After the data is valid in the dynamic memory elements of a selected row of firing cells in a particular fire group, a fire pulse is applied to the fire group. It should be noted that prior to selection of an address row in a fire group, the prior in-sequence address row in that fire group is selected and all 0's are applied to the data lines, so that the data in such prior in-sequence address row of firing cells is cleared. This prevents prior energizing data from causing the firing of heater resistors of non-addressed firing cells. An alternative mechanism for clearing old data would be to include a discharge transistor 104 (shown in broken lines in FIG. 5) in each of the firing cells. A separate discharge select line would be provided for each fire group, and the gates of all discharge transistors of all firing cells of a fire group would be connected to the discharge select line for that fire group. After a fire group receives a fire pulse, a discharge select signal for that fire group would be activated to remove any remaining charge on all of the dynamic memory elements of such fire group. This alternative method would require an additional transistor per firing cell and an additional interconnection for each fire group.

In this manner, data is sampled and stored in the selected row of firing cells, as indicated by the timing traces labelled Row Wn[15:0], Row Xn[15:0], Row Yn[15:0] and Row Zn[15:0], and the drive transistors in the selected row of firing cells are switched on before application of a fire pulse that starts after the data in the selected firing cells is valid. As depicted in FIG. 5B, each fire pulse for a particular fire group is shifted in time by a predetermined amount from the fire pulse of the adjacent fire group, whereby the fire pulses for the different fire groups are staggered and can be overlapping. For the illustrative example of four fire groups, the shift can be one-fourth of a firing cycle which is the interval between the start edges of consecutive pulses of the fire signal for a particular fire group. As further shown in FIG. 5B, firing data is stored in a selected row of firing cells during a storage time interval that is within a fire pulse time interval for a prior in sequence row of firing cells, wherein the storage time interval is defined by the address signal for the selected row. The pipelined organization of the fire groups, resulting from the dynamic memory based firing cells, allows the data signals to be time-multiplexed thereby supplying data information to all of the fire groups with a reduced number of external interconnections.

The organization of prior art firing cells 40 (FIG. 3) for similar operation would be an 8 row×64 column array. Providing for the same four ground connections as firing array 100, the total number of external interconnections for the prior art firing array 40 would be seventy-six. This compares to fifty-six external interconnections for the firing array 100. The comparison assumes both arrays have the same number of firing cells, operating at the same firing rate and have the same firing cycle. The reduced number of external interconnections is a significant advantage of the invention providing for higher reliability and lower cost printheads.

In addition, fewer external power switches are required for providing heater energizing fire pulses, four compared to sixty-four. This substantially reduces the cost of the drive electronics for a printhead constructed using the invention.

Another advantage of the firing array of FIG. 5A is the ability to stagger the fire pulses. This allows lower peak changes in current (di/dt) since fewer firing cells are being energized at the same time. This lowers the cost of the power supply system and reduces electromagnetic radiation. For the array of prior art firing cells 40, to accommodate a similarly timed fire pulse stagger, the firing rate would have to be reduced from the maximum possible (given a fixed number of address lines and a fixed firing cycle). This is due to the fact that all firing cells that are active at the same time (i.e., cells that have drive transistors switched on at the same time) share the same address line. For fire pulse staggering to take effect the address line must remain valid for a time period longer than the time needed for a single firing cycle. The firing array of FIG. 5A can support fire pulse staggering at the maximum firing rate.

The firing array of FIG. 5A is constructed with low cost NMOS processing, and does not require circuitry external to the firing array which typically would require more complex silicon processing such as CMOS and a more complex layout process. The cell based design of the firing array of FIG. 5A is simple to layout using a straightforward step-and-repeat procedure.

Figure 6:
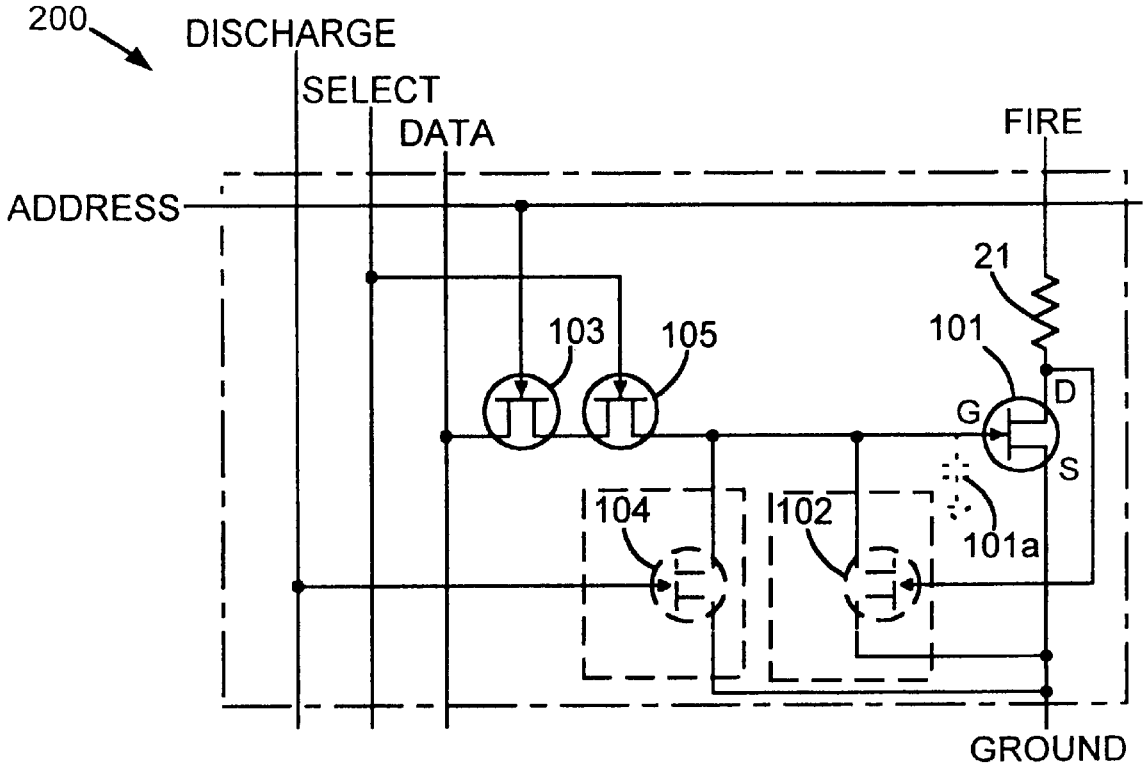
FIG. 6 sets forth a schematic circuit diagram of a further example of a dynamic memory based ink firing cell.

Referring now to FIG. 6, set forth therein is a schematic diagram of a further illustrative implementation of a dynamic memory based ink firing cell 200. The firing cell 200 includes an N-channel drive FET 101 for driving a heater resistor 21. The drain of the drive transistor 101 is connected to one terminal of the heater resistor 21, while the source of the drive transistor 101 is connected to a common reference voltage such as ground. The other terminal of the heater resistor 21 receives a resistor energizing FIRE signal that comprises ink firing pulses. Resistor energizing pulse energy is transferred to the heater resistor 21 if the drive transistor 101 is on at the time a FIRE pulse is present.

The gate of the drive transistor 101 forms a storage node capacitance 101*a* that functions as a dynamic memory element that stores resistor energizing or firing data received via an select transistor 105 and an address transistor 103 that is serially connected therewith. The storage node capacitance 101*a* is shown in dashed lines since it is actually part of the drive transistor 101. Alternatively, a capacitor separate from the drive transistor 101 can be used as a dynamic memory element. For increased flexibility as to discharging the capacitance 101*a* so as to set the capacitance to a known state, a discharge transistor 104 can be included. The discharge transistor 104 would have its drain connected to the gate of the drive transistor 101 and its source connected to ground, and a DISCHARGE select signal would be provided to the gate of the discharge transistor 104. The address transistor 103, the select transistor 105 and the gate capacitance 101*a* effectively form a dynamic memory data storage cell.

The gate of the address transistor 103 receives an ADDRESS signal that controls the state of the address transistor 103, while the input terminal of the address transistor 103 receives a firing DATA signal that is transferred to the input terminal of the select transistor 105 when the address transistor 103 is on. The gate of the select transistor 105 receives a SELECT signal and transfers the data on the output terminal of the address transistor 103 to the gate of the drive transistor 101 when the address transistor is on. Thus, data is transferred to the gate of the drive transistor 101 when the address transistor 103 and the select transistor are both on. Depending on the semiconductor processes utilized to implement the firing cell 200 of FIG. 6, a clamp transistor 102 connected between the drain and the gate of the drive transistor 101 may be required to prevent the gate of the drive transistor 101 from being unintentionally pulled high when the desired state of the gate is at ground and the FIRE signal goes high.

Figure 6A:
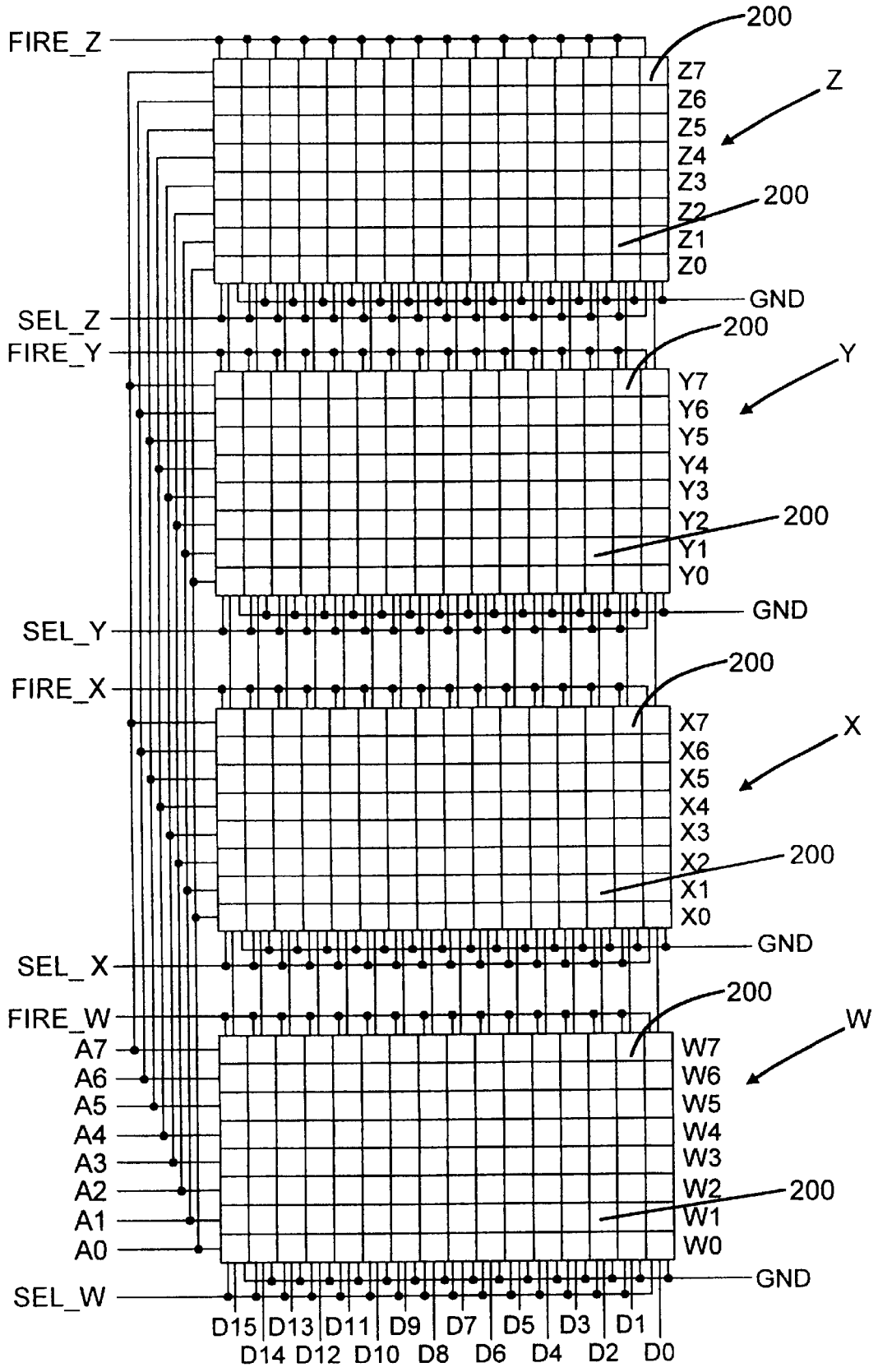
FIG. 6A sets forth a schematic layout of an ink jet ink firing array employing a plurality of ink firing cells of FIG. 6.

Referring now to FIG. 6A, set forth therein is a schematic layout of an ink jet ink firing array employing a plurality of ink firing cells 200 of FIG. 6 that are arranged in four fire groups W, X, Y, Z, wherein the ink firing cells are arranged in rows and columns in each of the fire groups, and wherein each firing cell 200 does not include the optional clamp transistor 102 or the optional discharge transistor 104. For reference, the rows of the respective ink fire groups W, X, Y and Z are respectively identified as rows W0 through W7, X0 through X7, Y0 through Y7 and Z0 through Z7. As with the array of FIG. 5A, it is convenient to refer to the rows of firing cells as address rows or fire subgroups of firing cells, whereby each fire group is comprised of a plurality of fire subgroups of firing cells.

Firing DATA signals are applied to data lines D0 through D15 that are associated with respective columns of all of the firing cells and are connected to external control circuitry by appropriate interface pads. Each of the data lines is connected to all of the input terminals of the address transistors 103 of the ink firing cells 200 in an associated column, and each firing cell is connected to only one data line. Thus, each of the data lines provides energizing data to firing cells in multiple rows in multiple fire groups.

ADDRESS control signals are applied to address control lines A0 through A7 that are connected to external control circuitry by appropriate interface pads. Each of the ADDRESS control lines is associated with respective corresponding rows from each of the firing groups W, X, Y and Z firing cells, whereby the address line A0 is connected to the gates of the address transistors 103 in the first rows of the firing groups (W0, X0, Y0, Z0), the address line A1 is connected to the gates of the address transistors 103 in the second rows of the firing groups (W1, X1, Y1, Z1), and so forth.

SELECT control signals are applied via select control lines SEL_W, SEL_X, SEL_Y and SEL_Z that are associated with the respective firing groups W, X, Y and Z, and are connected to external control circuitry by appropriate interface pads. Each of the select lines is connected to all of the select transistors 105 in the associated firing group, and all firing cells in a fire group are connected to only one select line.

Thus, each row or subgroup of firing cells is connected to a common subset of the ADDRESS and SELECT control lines, namely the ADDRESS control line for the row position of the subgroup and the SELECT control line for the fire group of the subgroup.

Heater resistor energizing FIRE signals are applied via fire lines FIRE_W, FIRE_X, FIRE_Y and FIRE_Z that are associated with the respective firing groups W, X, Y, and Z, and are connected to external power supply circuitry by appropriate interface pads. Each of the fire lines is connected to all of the heater resistors 21 in the associated fire group. All cells in a fire group share a common ground.

In operation, energizing data is stored in the array one row of firing cells at time, one fire group at a time, similarly to the operation of the firing array of FIG. 5A. In other words, fire groups are selected serially, and during each selection of a fire group, only one row of the selected fire group is selected. Within a fire group, rows are serially selected one row at a time at each selection of the fire group (e.g., (SEL_W, A1), (SEL_X, A1), (SEL_Y, A1), (SEL_Z, A1), (SEL_W, A2), (SEL_X, A2), (SEL_Y, A2), (SEL_Z, A2), etc.). With each row selection, data is applied in parallel to the data lines. After the data is valid in the dynamic memory elements of a selected row of firing cells in a particular fire group, a fire pulse is applied to the fire group. In this manner, energizing data is sampled and stored in the selected row of firing cells and the drive transistors in the selected row of firing cells are switched before application of an ink firing pulse which starts after the data in the selected firing cells is valid. Each firing pulse for a particular fire group is shifted by a predetermined amount from the firing pulse of the adjacent fire group, whereby the fire pulses for the different fire groups are staggered and can be overlapping. For the illustrative example of four fire groups, the shift can be one-fourth of a firing cycle which is the interval between the start edges of adjacent pulses of the fire signal for a particular fire group. The timing of the operation of the array of FIG. 6A would be similar to that of the array of FIG. 5A, except that a row or subgroup of ink firing cells is selected by a combination of ADDRESS control signals and SELECT control signals which also define a data storage interval.

The firing array in FIG. 6A has the advantages of the firing array in FIG. 5A with an additional reduction in the number of external interconnections required. An array incorporating firing cell 200 with the same number of firing cells, operating at the same firing rate and having the same firing cycle requires less than half the number of interconnections as a similarly sized array of prior art firing cells 40, thirty-six external interconnections compared to seventy-six external interconnections.

Figure 7:
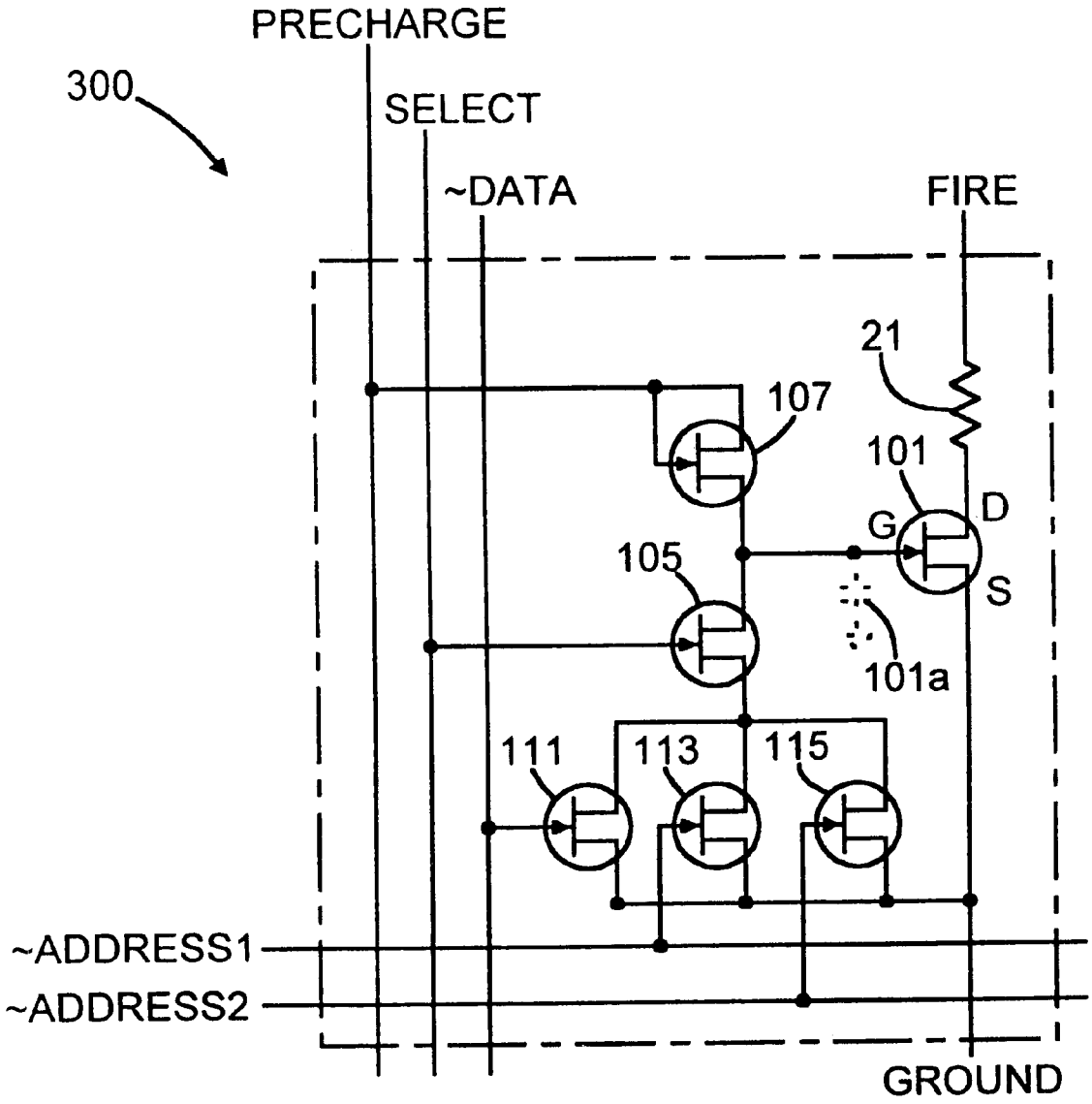
FIG. 7 sets forth a schematic circuit diagram of an example of a precharged dynamic memory based ink firing cell.

Referring now to FIG. 7, set forth therein is a schematic diagram of an illustrative implementation of a precharged dynamic memory ink firing cell 300. The firing cell 300 includes an N-channel drive FET 101 for driving a heater resistor 21. The drain of the drive transistor 101 is connected to one terminal of the heater resistor 21, while the source of the drive transistor 101 is connected to a common reference voltage such as ground. The other terminal of the heater resistor 21 receives a heater resistor energizing FIRE signal that comprises ink firing pulses. Firing pulse energy is transferred to the heater resistor 21 if the drive transistor 101 is on at the time the firing pulse is present.

The gate of the drive transistor 101 forms a storage node capacitance 101*a* that functions as a dynamic memory element that stores data pursuant to the sequential activation of a precharge transistor 107 and a select transistor 105. The storage node capacitance 101*a* is shown in dashed lines since it is actually part of the drive transistor 101. Alternatively, a capacitor separate from the drive transistor 101 can be used as a dynamic memory element.

The precharge transistor 107 more particularly receives a PRECHARGE select signal on its drain and gate that are tied together. The select transistor 105 receives a SELECT signal on its gate.

A data transistor 111, a first address transistor 113, and a second address transistor 115 are discharge transistors connected in parallel between the source of the select transistor 105 and ground. Thus, the parallel connected discharge transistors are in series with the select transistor, and the serial circuit comprised of the discharge transistors and the select transistor are connected across the gate capacitance 101*a* of the drive transistor 101. The data transistor 111 receives a firing ~DATA signal, the first address transistor 113 receives an ~ADDRESS1 control signal, and the second address transistor 113 receives an ~ADDRESS2 control signal. These signals are active when low, as indicated by the tilde (~) at the beginning of the signal name.

In the ink firing cell of FIG. 7, the select transistor 105, the precharge transistor 107, data transistor 111, the address transistors 113, 115, and the gate capacitance 101*a* effectively form a dynamic memory data storage cell.

In operation, the gate capacitance 101*a* is precharged by the precharge transistor 107. The ~DATA, ~ADDRESS1 and ~ADDRESS2 signals are then set up, and the select transistor 105 is turned on. If it is desired that the gate capacitance be not charged, at least one of the discharge transistors comprised of the data transistor 111 and the address transistors 113, 115 will be on. If it is desired that the gate capacitance remain charged, the discharge transistors comprised of the data transistor Ill and the address transistors 113, 115 will be off. In particular if the cell is not an addressed cell which is indicated by either ~ADDRESS1 or ~ADDRESS2 being high (i.e., either being de-asserted), the gate capacitance 101*a* is discharged regardless of the state of ~DATA. If the cell is an addressed cell which is indicated by both ~ADDRESS1 and ~ADDRESS2 being low, the gate capacitance 101*a* (a) remains charged if ~DATA is low (i.e., active) or (b) discharged if ~DATA is high (i.e., inactive).

Effectively, the gate capacitance 101*a* is precharged and is not actively discharged only if the ink firing cell is an addressed cell and if the firing data provided to it is asserted. The first and second address transistors 113, in 115 comprise address decoders, while the data transistor 111 controls the state of the gate capacitance when the ink firing cell is addressed.

In the firing cell of FIG. 7, since the data transistor 111 and at least one of the address transistors 113, 115 actively pulls down the gate of the drive transistor 101 when the cell is addressed and the firing data is low (i.e., the heater resistor should not be energized), or at least one of the address transistors actively pulls down the gate of the drive transistor 101 when the cell is not addressed, a clamp transistor to prevent the parasitic charging of the dynamic memory node can be avoided by overlapping the start of a FIRE pulse with a data cycle which is the time interval during which ~ADDRESS1, ~ADDRESS2 and ~DATA are valid and SELECT is active. It should be appreciated that when ~ADDRESS1, ~ADDRESS2 or ~DATA are de-asserted, the transistor receiving the respective signal is conductive. If desired, however, a clamp transistor can be connected between the drain and gate of the drive transistor 101 in the same manner as shown in the firing cells of FIGS. 5 and 6.

Figure 7A:
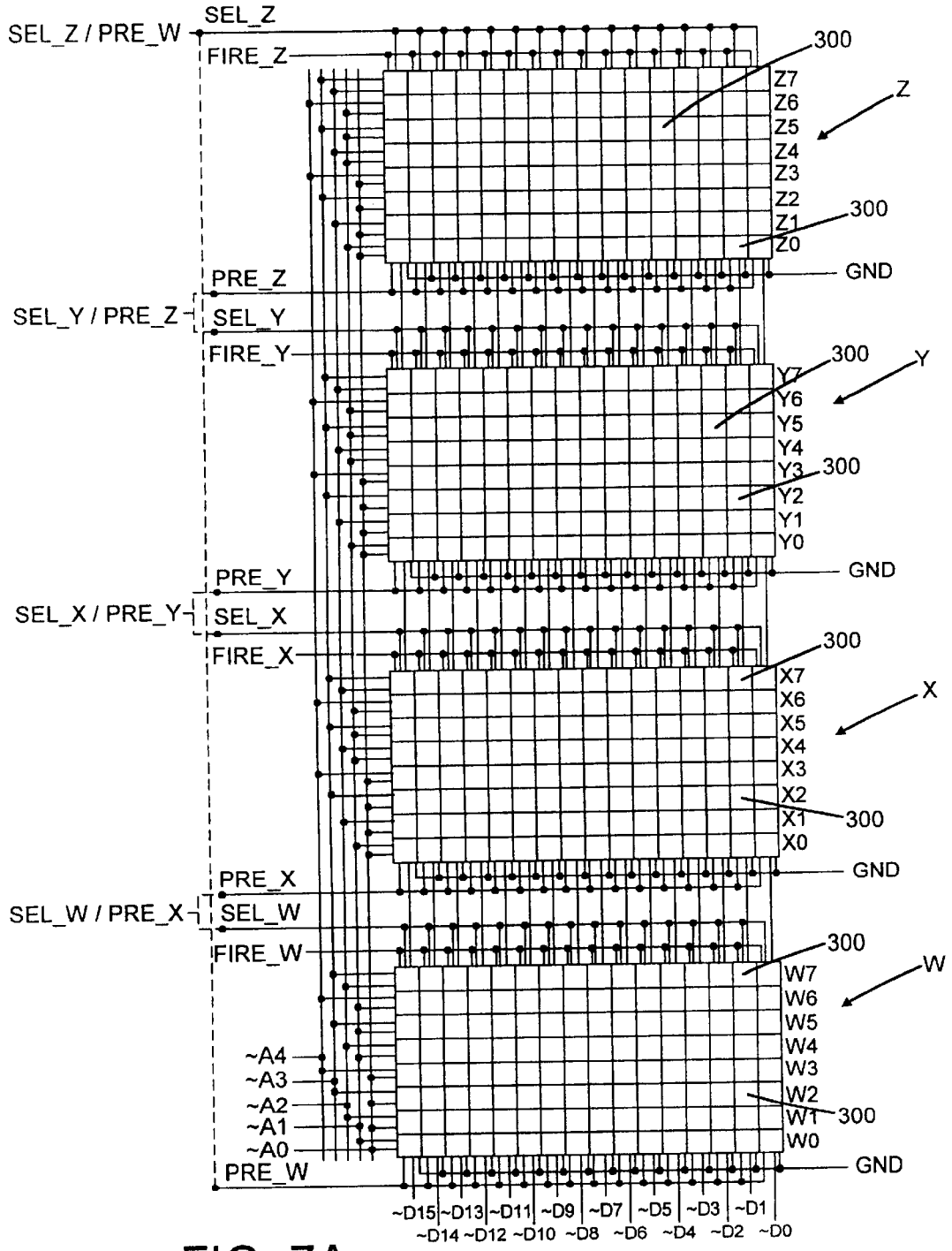
FIG. 7A sets forth a schematic layout of an ink jet ink firing array employing a plurality of ink firing cells of FIG. 7.

Referring now to FIG. 7A, set forth therein is a schematic layout of an ink jet ink firing array employing a plurality of precharged dynamic memory based ink firing cells 300 of FIG. 7 that are arranged in four fire groups W, X, Y, Z, wherein the ink firing cells are arranged in rows and columns in each of the fire groups. For reference, the rows of the respective fire groups W, X, Y and Z are respectively identified as rows W0 through W7, X0 through X7, Y0 through Y7 and Z0 through Z7. As with the arrays of FIGS. 5A and 6A, it is convenient to refer to the rows of firing cells as address rows or subgroups of firing cells, whereby each fire group is comprised of a plurality of subgroups of firing cells.

Firing DATA signals are applied to data lines ~D0 through ~D15 that are associated with respective columns of all of the firing cells, and are connected to external control data circuitry by appropriate interface pads. Each of the data lines is connected to all of the gates of the data transistors 111 of the ink firing cells 300 in an associated column, and each firing cell is connected to only one data line. Thus, each of the data lines provides energizing data to firing cells in multiple rows in multiple fire groups.

ADDRESS control signals are applied to address control lines ~A0 through ~A4 that are connected to the first and second address transistors 113, 115 of the cells of the rows of the array as follows:

~A0, ~A1: rows W0, X0, Y0 and Z0
~A0, ~A2: rows W1, X1, Y1 and Z1
~A0, ~A3: rows W2, X2, Y2 and Z2
~AC, ~A4: rows W3, X3, Y3 and Z3
~A1, ~A2: rows W4, X4, Y4 and Z4
~A1, ~A3: rows W5, X5, Y5 and Z5
~A1, ~A4: rows W6, X6, Y6 and Z6
~A2, ~A3: rows W7, X7, Y7 and Z7

In this manner, rows of firing cells are addressed as in the array of FIG. 6A by suitable set up of the address control lines ~A0 through ~A4. The address control lines are connected to external control circuitry by appropriate interface pads.

PRECHARGE signals are applied via precharge select control lines PRE_W, PRE_X, PRE_Y and PRE_Z that are associated with the respective fire groups W, X, Y and Z, and are connected to external control circuitry by appropriate interface pads. Each of the precharge lines is connected to all of the precharge transistors 107 in the associated fire group, and all firing cells in a fire group are connected to only one precharge line. This allows the state of the dynamic memory elements of all firing cells in a fire group to be set to a known condition prior to data being sampled.

In SELECT signals are applied via select control lines SEL_W, SEL_X, SEL_Y and SEL_Z that are associated with the respective fire groups W, X, Y and Z, and are connected to external control circuitry by appropriate interface pads. Each of the select control lines is connected to all of the select transistors 105 in the associated fire group, and all firing cells in a fire group are connected to only one select line.

Thus, each row or subgroup of firing cells is connected to a common subset of the address and select control lines, namely the address control lines for the row position of the subgroup as well as the precharge select control line and the select control line for the fire group of the subgroup.

Heater resistor energizing FIRE signals are applied via fire lines FIRE_W, FIRE_X, FIRE_Y and FIRE_Z that are associated with the respective fire groups W, X, Y and Z, and each of the fire lines is connected to all of the heater resistors in the associated fire group. The fire lines are connected to external supply circuitry by appropriate interface pads, and all cells in a fire group share a common ground.

The operation of the array of FIG. 7A is similar to the operation of array of FIG. 6A, with the addition of a PRECHARGE pulse prior to set up of the ADDRESS signals and assertion of the SELECT signal. The PRECHARGE pulse defines a precharge time interval while the SELECT signal defines a discharge time interval. Heater resistor energizing data is stored in the array one row of firing cells at time, one fire group at a time.

Since the fire groups are selected iteratively and since for each fire group a precharge pulse precedes a fire pulse, the select line for a particular fire group can be connected to the precharge line for the prior in-sequence in fire group to form combined control lines SEL_W/PRE_X, SEL_X/PRE_Y, SEL_Y/PRE_Z and SEL_Z/PRE_W, as shown in dashed lines in FIG. 7A, and that a combined SELECT/PRECHARGE signal can be utilized for each of the combined control lines.

Figure 7B:
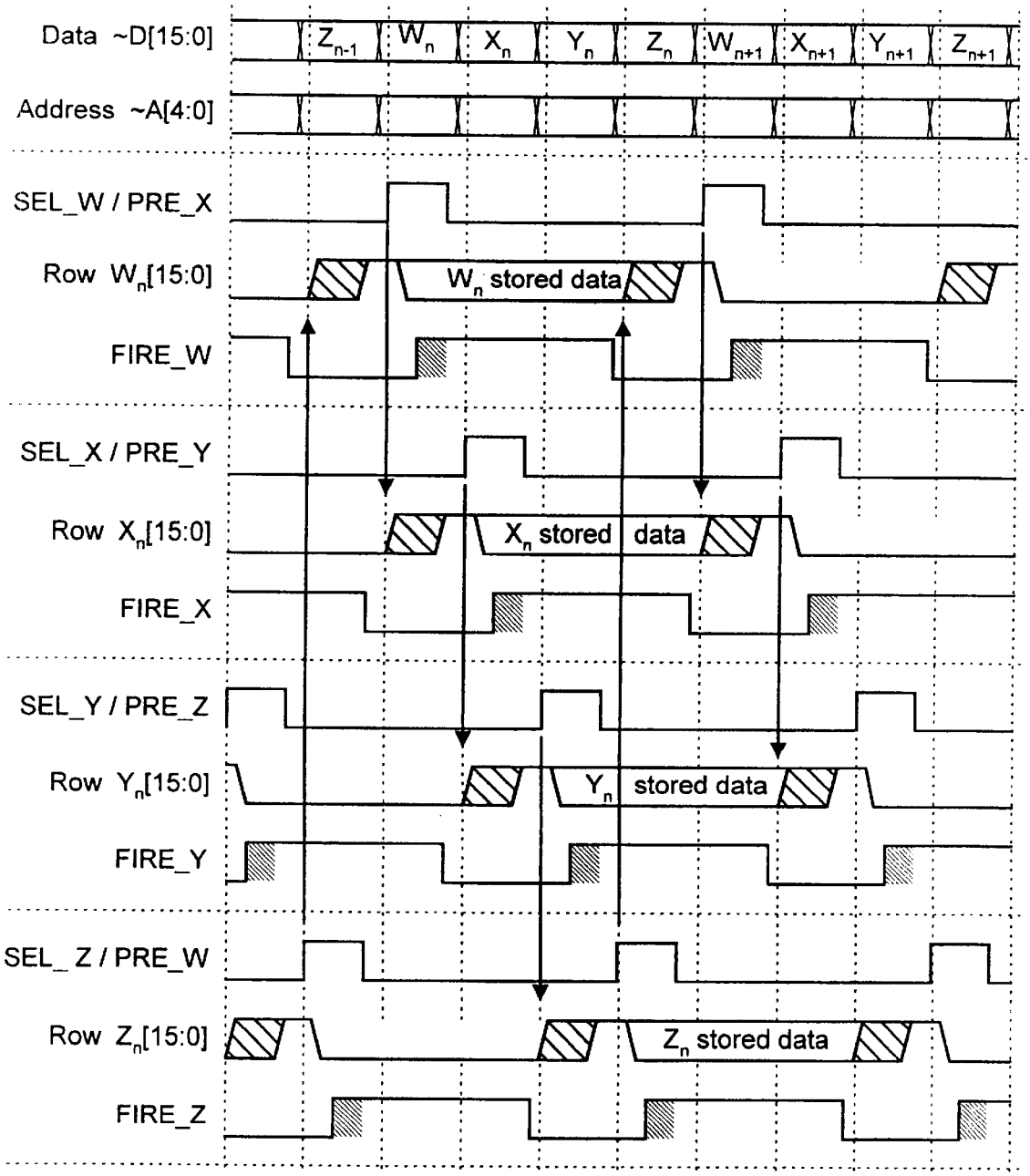
FIG. 7B sets forth a timing diagram for the ink jet ink firing array of FIG. 7A.

Referring now to FIG. 7B, set forth therein is a timing diagram of an illustrative example of the operation of the array of FIG. 7A for the particular example wherein the SELECT control line for a particular fire group is connected to the PRECHARGE line for the prior in-sequence firing group, and wherein the timing traces are identified for convenience by row or by the particular control lines carrying the signals represented by the timing diagram. Fire groups are selected serially, and during each selection of a fire group, only one row of the selected fire group is addressed via address control lines. Within a fire group, rows are serially addressed one row at a time at each selection of the firing group (e.g., (SEL_W, row W1), (SEL_X, row X1), (SEL_Y, row Y1), (SEL_Z, row Z1), (SEL_W, row W2), (SEL_X, row X2), (SEL_Y, row Y2), (SEL_Z, row Z2), etc.). With each fire group selection and row addressing, data is applied in parallel to the data lines ~D[15:0]. Data for the selected rows are identified as $W_n$, $X_n$, $Y_n$, $Z_n$, and so forth, while the state of the data in selected rows is indicated by the timing traces labeled Row $W_n$[15:0], Row $X_n$[15:0], Row $Y_n$[15:0], Row $Z_n$[15:0]. These timing traces also indicate by shaded regions the transition periods to the precharged state of the next to be selected rows. After the data is valid in the dynamic memory elements of a selected row or fire subgroup of firing cells in a particular fire group, a fire pulse is applied to the fire group.

In this manner, data is sampled and stored in the selected firing cells and the drive transistors in the selected cells are switched before application of an ink firing pulse which starts after the data in the selected firing cells is valid. As shown in FIG. 7B, each firing pulse for a particular fire group is shifted in time by a predetermined amount from the firing pulse of the adjacent fire group, whereby the fire pulses for the different fire groups are staggered and can be overlapping. For the illustrative example of four firing groups, the shift can be one-fourth of a firing cycle which is the interval between the start edges of consecutive pulses of the fire signal for a particular firing group. As further shown in FIG. 7B, firing data is stored in a selected row of firing cells during a storage time interval that is within a fire pulse interval for a prior in sequence row of firing cells, wherein the storage time interval is defined by the control signals on the address control lines and select line for the selected row.

In the operation of the array of FIG. 7A, the data cycle during which the address signals and the data signals are valid and the select signal is active can be overlapped with a fire signal, as shown in FIG. 7B by shaded areas in the fire signals, to actively hold the gate of a drive transistor low during the firing pulse rise time when the desired state of the firing cell is zero (i.e., no firing), which advantageously eliminates the need for a clamp transistor. This is a more robust technique for ensuring that parasitic charging of the dynamic memory node is avoided.

The firing array in FIG. 7A offers an improvement in number of interconnects required when compared to the firing array in FIG. 6A, thirty-three compared to thirty-six. A significant advantage of the firing cell 300 of FIG. 7A is that the data and address signals are no longer required to be high voltage signals. This is due to the fact that they are driving ground referenced FETs instead of pass transistors. The address and data signals can be driven from standard voltage logic circuitry which lowers the cost of the printhead drive electronics.

Figure 8:
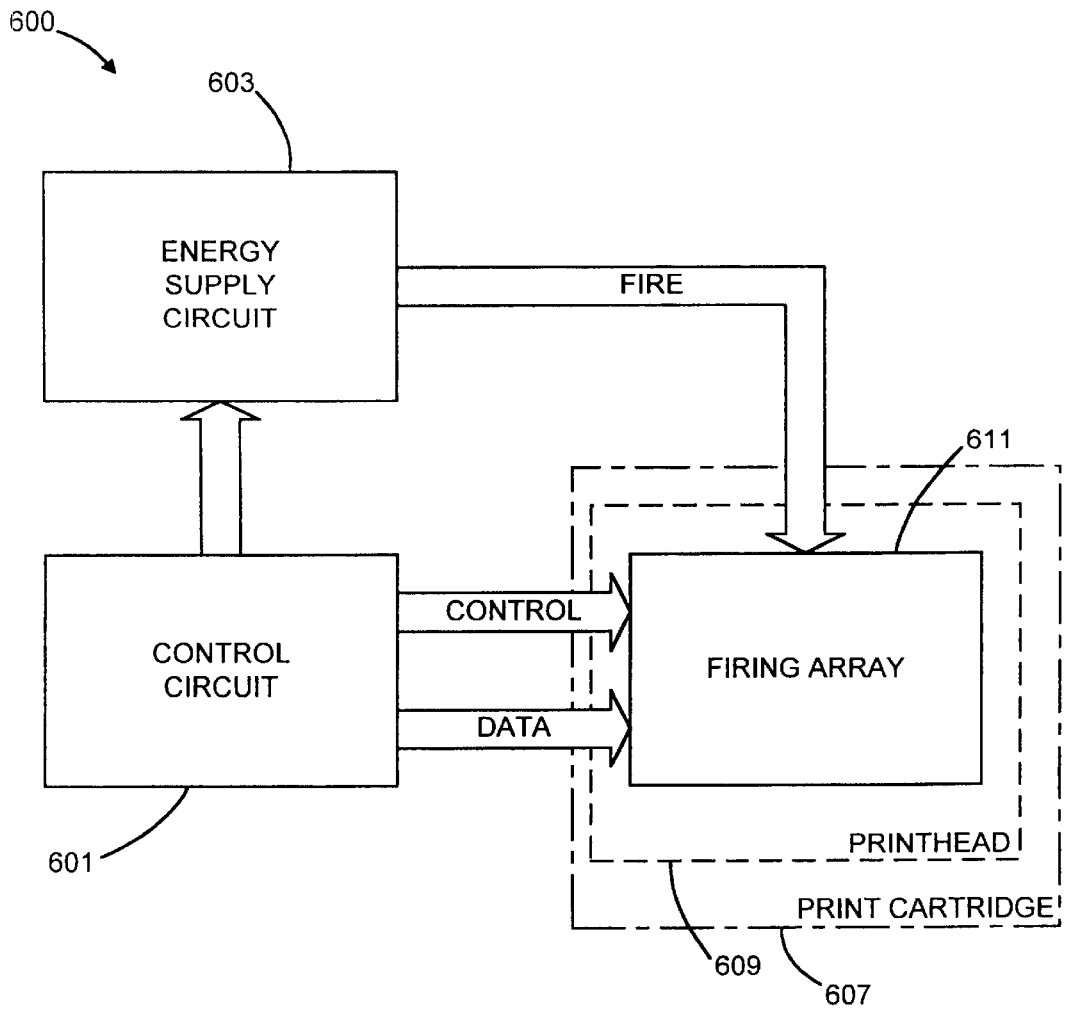
FIG. 8 is a schematic electrical block diagram of a printer system that employs a dynamic memory based ink firing array.

Referring now to FIG. 8, set forth therein is a simplified block diagram of a printer system 600 that includes an ink jet print cartridge 607 having an inkjet printhead 609 that employs a dynamic memory based ink firing array 611 as disclosed herein. The printer system includes a control circuit 601 that provides address and/or select control signals and data signals to the firing array 611, and further controls an energy supply circuit 603 that provides heater resistor energizing fire signals to the printhead. Each of the address signals is provided to all firing cells of one or more rows of the firing array 611, while the select control signals comprise select, precharge select, and/or discharge select signals each of which is global to all cells in an associated fire group.

The foregoing has been a disclosure of an integrated circuit ink jet firing array that includes dynamic memory based firing cell circuits that respectively store firing data for the respective heater resistors of the firing cells, which advantageously allows firing data lines to be shared whereby firing data for a subgroup of firing cells is loaded prior to firing of the heater resistors of such subgroup while heater resistors of a prior in-sequence subgroup of firing cells is firing, which in turn reduces the number of external interconnections required. Dynamic memory based integrated circuit ink jet firing arrays in accordance with the invention are economically implemented using NMOS integrated circuit processes substantially similar to those used to implement prior art firing arrays comprised of single transistor de-multiplexing ink firing cells.

Although the foregoing has been a description and illustration of specific embodiments of the invention, various modifications and changes thereto can be made by persons skilled in the art without departing from the scope and spirit of the invention as defined by the following claims.

What is claimed is:

1. An integrated circuit firing array for a thermal ink jet printhead comprising:

a plurality of firing cells, each firing cell comprising:

an ink jet heater resistor, a dynamic memory element for receiving and storing energizing data presented to the firing cell only for said ink jet heater resistor, a data switching circuit for selectively transferring said energizing data to said dynamic memory element based upon control information received by the firing cell, and an energy switching circuit for enabling a transfer of energizing energy received by the firing cell to said heater resistor as a function of a state of said energizing data stored on said dynamic memory element;

said plurality of firing cells being divided into a plurality of fire groups of firing cells, and each of said fire groups having a plurality of fire subgroups of firing cells;

a plurality of data lines connected to said plurality of firing cells for providing energizing data to said plurality of firing cells, wherein each of said data lines provides energizing data to firing cells in multiple subgroups in multiple fire groups, and wherein each of said firing cells of each of said fire subgroups is connected to only one of said data lines;

a plurality of control lines connected to said plurality of firing cells for providing control information to said plurality of firing cells, wherein all firing cells within each of said fire subgroups are connected to a common subset of said control lines which allows for concurrent storage of energizing data in all firing cells within each of said subgroups; and a plurality of fire lines connected to said plurality of firing cells for supplying energizing energy to said plurality of firing cells, wherein all firing cells of each of said fire groups are connected to only one of said fire lines.

2. The integrated circuit firing array of claim 1 wherein said control lines include:

a plurality of address lines each connected to all firing cells in a respective one of said fire subgroups; and a plurality of select lines each connected to all firing cells of a respective one of said fire groups.

3. The integrated circuit firing array of claim 2 wherein each firing cell is connected to only one address line.

4. The integrated circuit firing array of claim 2 wherein each firing cell is connected to multiple address lines.

5. The integrated circuit firing array of claim 2 wherein a select line allows for concurrent storage of a predetermined data state in all firing cells of a selected fire group.

6. An integrated circuit firing cell for a thermal ink jet printhead, comprising:

an ink jet heater resistor;

a capacitive memory element for receiving and storing energizing data only for said heater resistor, wherein said energizing data is represented by whether said capacitive memory element is charged or discharged;

a precharge circuit for controllably precharging said capacitive memory element;

a discharge circuit for controllably discharging said capacitive memory element; and an energy switching circuit for enabling a transfer energizing energy to said heater resistor as a function of a state of said energizing data stored by said capacitive memory element.

7. The integrated circuit firing cell of claim 6 wherein said energy switching circuit comprises an FET, and wherein said capacitive memory element comprises a gate capacitance of said FET.

8. The integrated circuit firing cell of claim 7 wherein said discharge circuit includes:

a plurality of discharge transistors connected in parallel;

a select transistor connected in series with said discharge transistors;

said plurality of discharge transistors and said select transistor being connected across said gate capacitance.

9. The integrated circuit firing cell of claim 8 wherein at least one of said plurality of discharge transistors and said select transistor are controlled so as to be conductive during an initial portion of a transfer of energizing energy to said heater resistor to maintain a discharged state of said capacitive memory element when said capacitive memory element is discharged.

10. The integrated circuit firing cell of claim 7 further including a clamp circuit for preventing parasitic charging of said gate capacitance.

11. The integrated circuit firing cell of claim 10 wherein said clamp circuit is connected across a drain and a gate of said FET.

12. An integrated circuit firing array for a thermal ink jet printhead comprising:

a plurality of firing cells, each firing cell comprising:

an ink jet heater resistor, a capacitive memory element for receiving and storing energizing data only for said heater resistor, wherein said energizing data is represented by whether said capacitive memory element is charged or discharged, a precharge circuit for controllably precharging said capacitive memory element pursuant to control information received by the firing cell, a discharge circuit for controllably discharging said capacitive memory element pursuant to control information received by the firing cell, and an energy switching circuit for enabling a transfer of energizing energy received by the firing cell to said heater resistor as a function of a state of said energizing data stored on said capacitive memory element;

said plurality of firing cells being divided into a plurality of fire groups of firing cells, and each firing group having a plurality of fire subgroups of firing cells;

a plurality of data lines for providing energizing data to said plurality of firing cells, wherein each of said data lines provides energizing data to firing cells in multiple subgroups in multiple fire groups, and wherein each of said firing cells of each of said fire subgroups receives energizing data from only of said data lines;

a plurality of control lines for providing control information to said plurality of firing cells, wherein all firing cells within each of said fire subgroups are controlled by a common subset of said control lines which allows for concurrent storage of energizing data in all firing cells within each of said fire subgroups;

a plurality of fire lines for supplying energizing energy to said plurality of firing cells, wherein all firing cells of each of said fire groups receive energizing energy from only)one of said fire lines.

13. The integrated circuit firing array of claim 12 wherein said control lines include:

precharge lines for providing precharge control information to said plurality of firing cells;

select lines for providing select control information to said plurality of firing cells; and address lines for providing subgroup address information to said plurality of firing cells.

14. The integrated circuit firing array of claim 13 wherein:

all firing cells in each of said fire groups are connected to only one of said precharge lines and only one of said select lines; and all firing cells in each of said fire subgroups are connected to a common subset of said address lines.

15. The integrated circuit firing array of claim 14 wherein said select line for one of said fire groups is connected to said precharge line for a different one of said fire groups.

* * * * *

UNITED STATES PATENT AND TRADEMARK OFFICE

CERTIFICATE OF CORRECTION

PATENT NO. : 6,439,697 B1
DATED : August 27, 2002
INVENTOR(S) : Axtell et al.

It is certified that error appears in the above-identified patent and that said Letters Patent is hereby corrected as shown below:

Title page, Item [54] and Column 1, line 2,
"OF" should read -- FOR --.

Signed and Sealed this

Eighteenth Day of February, 2003

JAMES E. ROGAN
*Director of the United States Patent and Trademark Office*